US006195854B1

(12) United States Patent
Catallo

(10) Patent No.: US 6,195,854 B1
(45) **Date of Patent: *Mar. 6, 2001**

(54) APPARATUS AND METHOD FOR SOFTENING A FABRIC WEB MATERIAL

(76) Inventor: Frank Catallo, 84 Wheatley Rd., Old Westbury, NY (US) 11568

( * ) Notice: Subject to any disclaimer, the term of this patent is extended or adjusted under 35 U.S.C. 154(b) by 0 days.

This patent is subject to a terminal disclaimer.

(21) Appl. No.: 09/419,449

(22) Filed: Oct. 15, 1999

Related U.S. Application Data

(63) Continuation-in-part of application No. 09/075,741, filed on May 11, 1998, now Pat. No. 5,966,785, which is a continuation-in-part of application No. 08/994,469, filed on Dec. 19, 1997, now abandoned.

(51) Int. Cl.[7] ..... D06C 19/00
(52) U.S. Cl. ..... 26/27; 26/71
(58) Field of Search ..... 26/27, 71, 28, 26/25, 26, 99, 104, 106; 264/290.7, 288.4, 292

(56) References Cited

U.S. PATENT DOCUMENTS

| | | | | |
|---|---|---|---|---|
| 1,376,736 | * | 5/1921 | Thornber | 26/97 |
| 1,730,520 | * | 10/1929 | McMurray | 26/27 |
| 3,266,117 | * | 8/1966 | Sapilevsky | 26/27 |
| 3,363,276 | * | 1/1968 | Thomas, Jr. | 26/27 |
| 3,408,709 | * | 11/1968 | Reitz | 26/27 |
| 4,087,226 | * | 5/1978 | Mercer | 425/397 |
| 4,368,565 | * | 1/1983 | Schwarz | 26/99 |
| 4,769,879 | * | 9/1988 | Otto | 26/27 |
| 5,167,054 | * | 12/1992 | Eschenbach | 26/27 |
| 5,455,992 | * | 10/1995 | Kurschatke et al. | 26/99 |
| 5,619,779 | * | 4/1997 | Geyer | 26/97 |

FOREIGN PATENT DOCUMENTS

| | | | | |
|---|---|---|---|---|
| 494033 | * | 10/1938 | (GB) | 26/21 |

* cited by examiner

*Primary Examiner*—Amy B. Vanatta
(74) *Attorney, Agent, or Firm*—Charles E. Baxley

(57) ABSTRACT

An apparatus for imparting soft hand to a non-woven, paper, paper with synthetic fibers and/or additives, printed knit fabrics and the like in web form, by mechanically introducing localized tensions on diverse preselected situses of the web. The web is preferably advanced in continuous rubbing engagement with one or more contact members that can be pairs of nip rollers and/or breaker bars. Nip roller pairs include one irregularly surfaced roller deformably engaging into a soft roller with the web passing therebetween. Breaker bars can have straight, serrated or curvilinear edges and the web can be passed over or under the breaker bars. Various combinations of nip roller pairs and breaker bars are provided for and preferably a variable drive can be employed.

39 Claims, 4 Drawing Sheets

FIG. 5
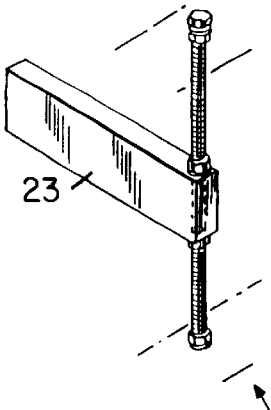
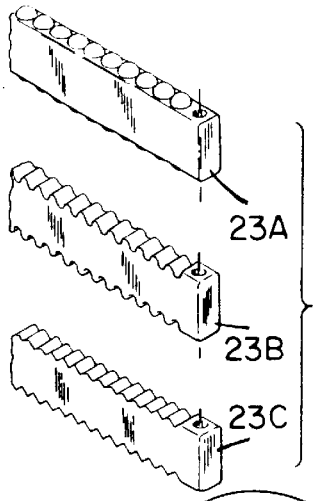
FIG. 6
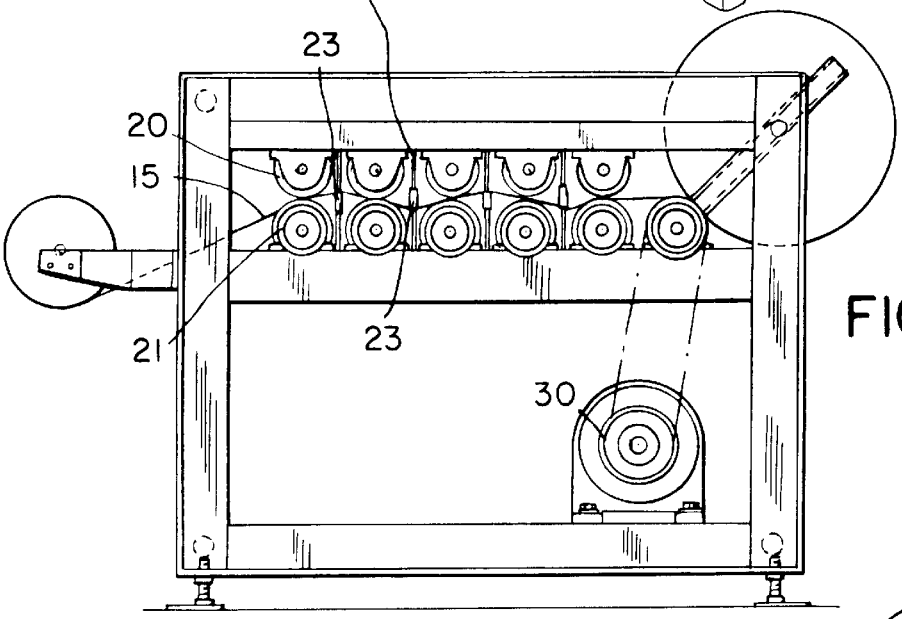
FIG. 1
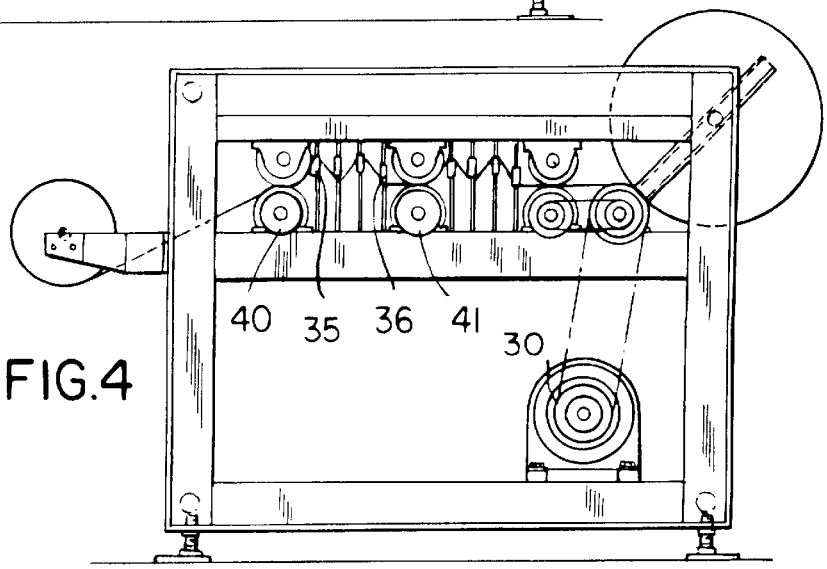
FIG. 4

FIG. 2
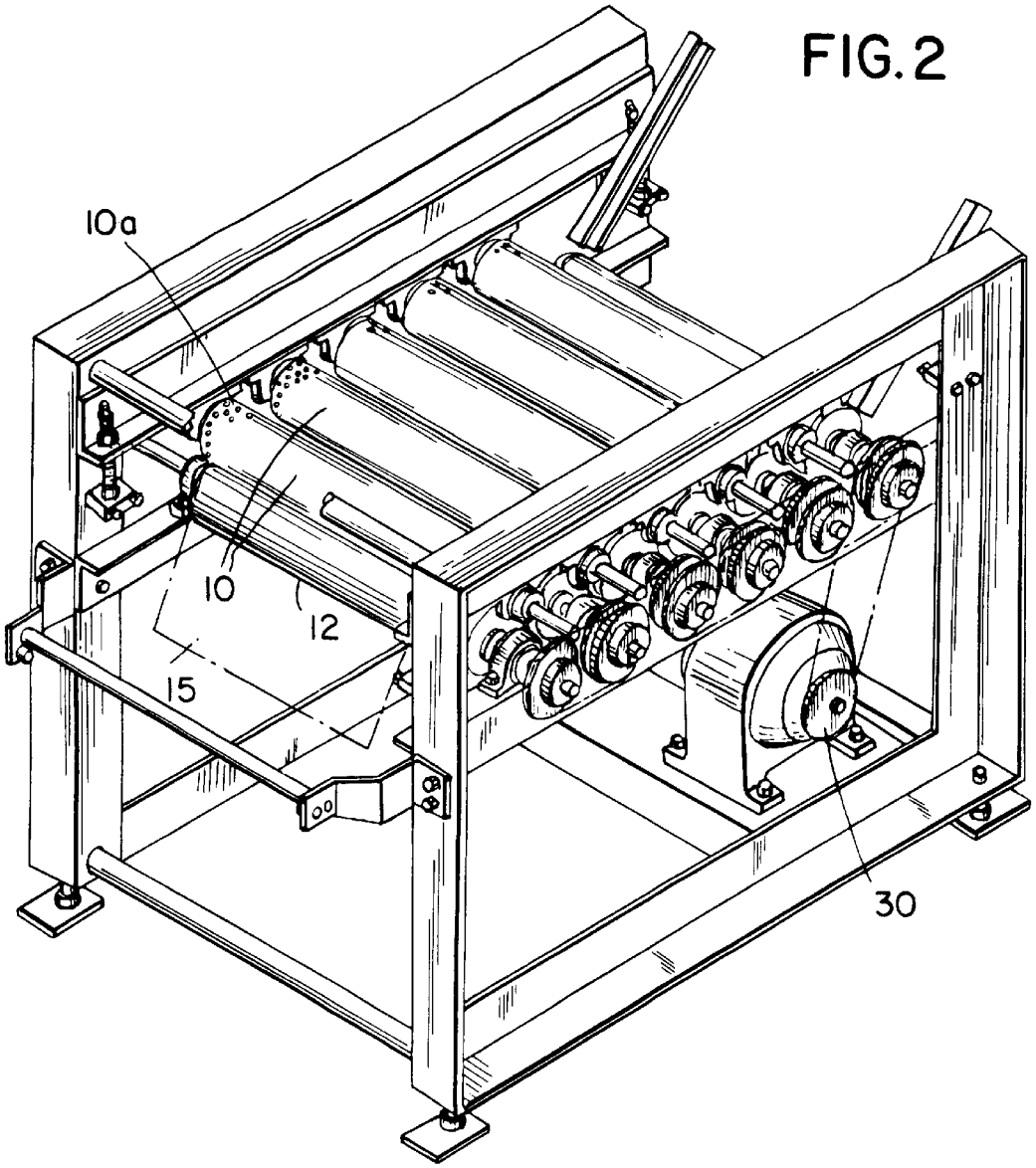
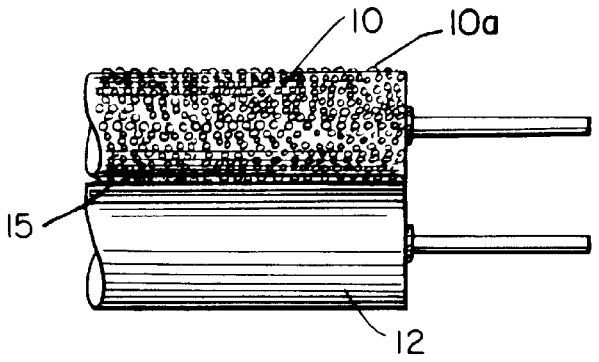
FIG. 3

APPARATUS AND METHOD FOR SOFTENING A FABRIC WEB MATERIAL

PRIOR APPLICATIONS

The present Application is a continuation-in-part of U.S. patent application Ser. No. 09/075741 filed on May 11, 1998, now U.S. Pat. No. 5,966,785 which, in turn was a continuation-in-part of U.S. application Ser. No. 08/994,469 filed on Dec. 19, 1997 that now is abandoned.

BACKGROUND OF THE INVENTION

The present invention relates to an apparatus for softening a web material by exerting local tensions at predetermined situses on the web.

Certain types of fabric web materials such as non-wovens, paper, paper with synthetic fibers and/or additives, printed knits and the like generally have a harsh hand or feel. Manufacturers and finishers of these fabrics have tried to soften the fabrics and improve their drape by applying chemical treatments, compacting and sometimes washing the web following same by relaxed drying. Chemical treatment is expensive and requires application apparatus plus drying equipment. Compacting increases weight of a fabric web material and also its cost. Washing and drying fabric webs also are expensive.

Printed woven fabrics have been, and still are, softened by applying longitudinal tension while at the same time passing the material in contact with several rollers that have a button head knobbed surface. This procedure causes application of localized tensions on the material as the knobs protrude into and stretch the fabric breaking its printed pigment surface thereby to end up with a softer fabric. A machine of this type is referred to in the art as a "Button Breaker." While a Button Breaker works reasonably well on woven fabrics, it distorts other materials such as non-wovens, paper, paper with synthetic fibers and/or additives, and knits to a degree that substantially damages them. Usually imposing longitudinal tension on a knitted fabric stretches the fabric and curls or rolls its edges making the fabric undesirable for use.

SUMMARY OF THE INVENTION

It is therefore an object of the present invention to provide an apparatus which functions to impart a soft feel or hand to a fabric web material which feel or hand is very desirable.

Another object of the present invention is to provide an apparatus for achieving soft and desirable hand in an inexpensive and efficient manner.

Another object of the present invention is to soften fabric webs, especially non-wovens, paper, paper with synthetic fibers and/or additives, and printed knits, without applying excessive longitudinal tension thereto.

Another object of the present invention is to provide an inexpensive mechanical apparatus for softening various fabric web materials, especially non-wovens, paper, paper with synthetic fibers and/or additives, and printed knits, without substantially changing weight, shape or size of the fabric web and achieving at the same time a soft feel or hand to the fabric web.

Another object of the present invention is to offer a versatile selection among equipment arrangements and techniques for application to particular needs of various of the fabric webs to be softened.

Generally speaking, an apparatus according to the present invention comprises a means for allowing movement of the fabric web material through the apparatus and while the fabric web is so moving the apparatus imparts localized tension thereto in various predetermined locations distributed over the fabric web.

The foregoing and other objects and advantages of the present invention will appear more clearly hereinafter.

BRIEF DESCRIPTION OF THE DRAWINGS

Other important objects and advantages of the present invention will be apparent from the following detailed description taken in connection with accompanying drawings wherein like numerals refer to like parts throughout and wherein:

FIG. 1 is a side elevational view of an apparatus according to the present invention for acting on a fabric material to soften same;

FIG. 2 is a prospective view of another embodiment of the apparatus;

FIG. 3 is a simplified and broken away view of a knobbed roller co-acting with a soft rubber-covered roller;

FIG. 4 is a side elevational view showing another embodiment of the apparatus which likewise permits one to achieve objectives of the present invention;

FIG. 5 is an isolated, enlarged, broken isometric view of a breaker bar from FIG. 1 with a straight edge;

FIG. 6 shows breaker bars with buttons 23A, curvilinear edge 23B and serrations 23C;

DESCRIPTION OF PREFERRED EMBODIMENTS

Figure 7B:
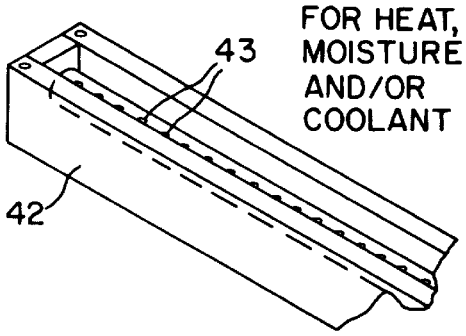
FIG. 7 is a side elevational view showing another embodiment of the present invention with a sprayer box for applying moisture, steam and/or a cooling substance to the web.

Referring to the drawings, various embodiments for achieving the soft and desirable hand are shown. In FIG. 2, an arrangement is shown comprising a plurality of rollers each having a relatively hard knobbed roller 10 which presses into a cooperating rubber or similar roller 12. As shown in FIG. 3 knobs 10*a* of the button roller 10 press into the soft roller 12 and stretch a web locally at various preselected situses without applying substantial longitudinal tension to a fabric web 15 being processed, as shown in FIG. 2, and soft hand of the fabric web results. Likewise in FIG. 8, ridges 10*b* press into soft roller 12.

Another form of the apparatus is shown in FIGS. 1, 5 and 6 wherein the fabric web 15 passes through upper and lower rolls 20, 21 and in rubbing engagement over or under a breaker bar 23, seen more clearly in FIG. 5. That arrangement also imparts localized tension to a web. The fabric may be arranged by adjusting the breaker bar 23 as shown in FIG. 4 so that the web runs through a pair of rollers 40 then in rubbing engagement over the top of one bar 23 and then in rubbing engagement under the bottom of another bar 23 as is similarly shown in FIG. 1. Also as shown in FIG. 6, edges of the breaker bar 23 can be straight 23, buttoned 23A, serrated 23C, curvilinear 23B or combinations thereof. A variable speed drive 30 is arranged to turn a preselected roller, as shown, which moves the web 15 through one or more pairs of rollers 20, 21 and over or under a desired number of breaker bars 23 for rubbing engagement therewith.

Various arrangements of locating the web between the breaker bars 23 may be used, as shown in FIGS. 1 and 4, in order to achieve desirable web softening results. Such disposition is shown particularly in FIG. 4, for example, wherein the web material passes through a pair of rollers 40 then continuously in rubbing engagement over a breaker bar 35 then in rubbing engagement under a succeeding breaker bar at 36, through another pair of rollers 41 and so on. As will be understood, it may not be necessary to run the web both between nip rollers and also over and/or under a breaker bar. A non-woven web sometimes softens considerably by just passing the material in rubbing engagement continuously over and under one or more of the breaker bars 23, in which case the nip rollers would merely control overall web tension. In circumstances, depicted in FIGS. 3 and 8, where relatively hard knobs 10*a* or ridges 10*b* are provided, the rubber roller 12 yields locally to pressing by the knobs 10*a* or ridges 10*b*. The rubber roller 12 normally has an approximate durometer hardness of about 15.

Figure 8B:
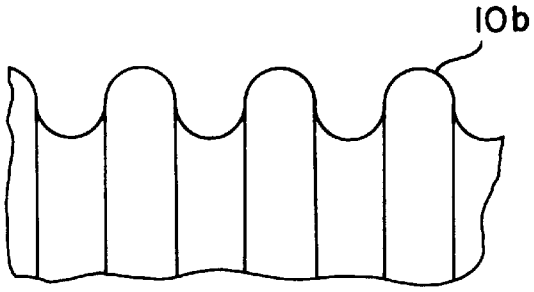
FIG. 8 is a detailed view of a grooved version of an irregularly shaped roller which can be used instead of, or in addition to, a knobbed roller.
Figure 8A:
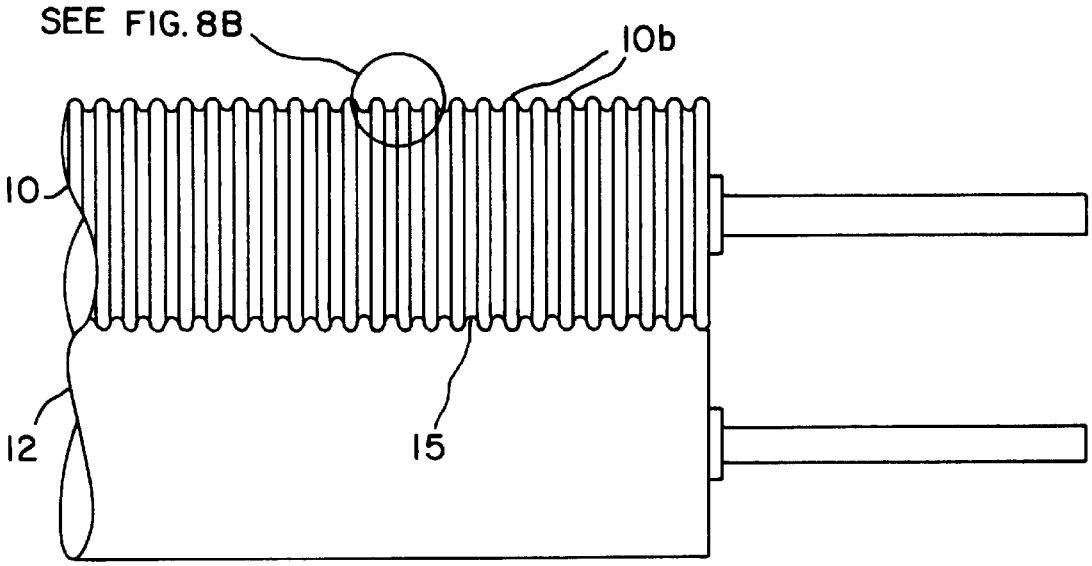

As seen in FIG. 8, the irregularly surfaced relatively hard roller will usually be metal. Grooves are shown to form the irregular surface. The grooves typically have a wave length of one-half inch (½") whereby each ridge is one quarter of an inch (¼") in width on its neighboring troughs are each one quarter of an inch (¼"). Other sizes have also been used in varying nip arrangements. Where plural pairs of nip rollers are used, for example, a first nip typically would be one fourth of an inch (¼"), a second nip three sixteenths of an inch (3/16") and a third nip one eighth of an inch (⅛") to treat the fabric web more evenly over its width. Many other groove shapes and configurations can also be employed within the teaching of this invention.

Figure 7A:
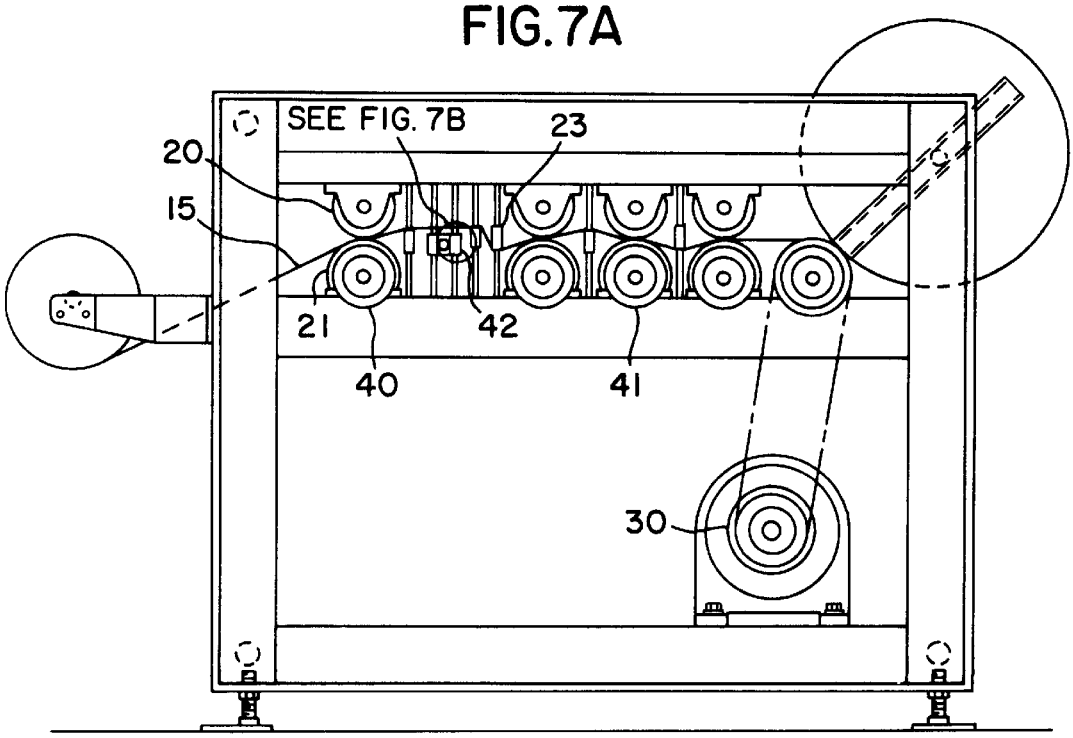

In FIG. 7 an injection box 42 is shown with nozzles 43 for application of moisture, heat and/or coolant to the web so as to assist in softening the web 15.

Having described the present invention in detail, it is obvious that one skilled in the art will be able to make variations and modifications to same without departing from a disclosed scope of the invention. Accordingly, the scope of the present invention can be seen further from claims which follow.

I claim:

1. An apparatus for imparting soft hand to a web of a fabric material, the apparatus comprising:

a pair of nip rollers through which the web is passed;

the pair of nip rollers including one irregular surfaced roller having protrusions thereon and a paired relatively soft roller organized to yield locally under pressure of the protrusions thereinto.

2. The apparatus of as claimed in claim 1, with means for introducing moisture to the web.

3. The apparatus as claimed in claim 1, with means for heating the web.

4. The apparatus as claimed in claim 1, with means for cooling the web.

5. The apparatus as claimed in claim 1, with a plurality of the pairs of nip rollers.

6. The apparatus as claimed in claim 5, with a variable speed drive arranged to turn a preselected one of the nip rollers.

7. The apparatus as claimed in claim 1, wherein the protrusions are arranged on the irregularly surfaced roller in a decorative pattern that repeats on the web.

8. The apparatus as claimed in claim 1, wherein the protrusions are knobs provided with an arcuate surface.

9. The apparatus as claimed in claim 1, wherein the protrusions are irregular in shape.

10. The apparatus as claimed in claim 1, wherein the protrusions are ridges.

11. The apparatus of claim 10, wherein the ridges are arranged longitudinally relative to a general path of travel of the web.

12. An apparatus for imparting soft hand to a web of fabric material, selected from a group consisting of printed knits, non-wovens, paper and paper with synthetic fibers and/or additives, the apparatus comprising:

a pair of nip rollers through which the web of the fabric is passed, the pair of nip rollers including one irregularly surfaced roller having protrusions thereon and a paired relatively soft roller organized to yield locally under pressure of the protrusions thereinto.

13. The apparatus of claim 12, with a plurality of the pairs of nip rollers.

14. The apparatus of claim 12, with means for introducing moisture to the web.

15. The apparatus of claim 12, with means for heating the web.

16. The apparatus of claim 12, with means for cooling the web.

17. The apparatus of claim 13, with a variable speed drive arranged to turn a preselected one of the nip rollers.

18. The apparatus of claim 12, wherein the protrusions are arranged on the irregularly surfaced roller in a decorative pattern that repeats on the web.

19. The apparatus of claim 12, wherein the protrusions are knobs provided with an arcuate surface.

20. The apparatus of claim 12, wherein the protrusions are knobs which are irregular in shape.

21. The apparatus of claim 12, wherein the protrusions are ridges.

22. The apparatus of claim 12, wherein the ridges are arranged longitudinally relative to a general path of travel of the web.

23. An apparatus for imparting soft hand web of a fabric material, selected from a group consisting of non-wovens, paper, paper with synthetic fibers and printed knits, the fabric material having a first side and an opposite second side, the apparatus comprising:

a first physical contact member and a second physical contact member;

means for advancing the web with the first side in continuous rubbing engagement with the first physical contact member and with the second side in continuous rubbing engagement with the second physical contact member, whereby localized tension is developed in the fabric;

and means for introducing moisture to the web.

24. An apparatus for imparting soft hand web of a fabric material, selected from a group consisting of non-wovens, paper, paper with synthetic fibers and printed knits, the fabric material having a first side and an opposite second side, the apparatus comprising:

a first physical contact member and a second physical contact member;

means for advancing the web with the first side in continuous rubbing engagement with the first physical contact member and with the second side in continuous rubbing engagement with the second physical contact member, whereby localized tension is developed in the fabric;

and means for introducing heat to the web.

25. An apparatus for imparting soft hand web of a fabric material, selected from a group consisting of non-wovens, paper, paper with synthetic fibers and printed knits, the fabric material a first side and an opposite second side, the apparatus comprising:

a first physical contact member and a second physical contact member;

means for advancing the web with the first side in continuous rubbing engagement with the first physical contact member and with the second side in continuous rubbing engagement with the second physical contact member, whereby localized tension is developed in the fabric;

and means for cooling the web.

26. A method for imparting soft hand to a web of material, the method comprising steps of:

passing the web through a pair of nip rollers which include one irregularly surfaced roller having protrusions thereon and a paired relatively soft roller organized to yield locally under pressure of the protrusions thereinto;

whereby localized tension is developed in the web.

27. The method of claim 26, and introducing moisture to the web.

28. The method of claim 26, and introducing heat to the web.

29. The method of claim 26, and cooling the web.

30. The method as claimed in claim 26, and passing the web through a plurality of pairs of the nip rollers.

31. The method as claimed in claim 26, and providing a variable speed drive arranged to turn a preselected one of the rollers.

32. The method as claimed in claim 26, and organizing the protrusions on the irregularly surfaced in a pattern to impart to the web a decorative design that repeats thereon.

33. The method as claimed in claim 26, and providing knobs with arcuate surfaces as the protrusions.

34. The method as claimed in claim 26, and providing irregular shapes to the protrusions.

35. The method as claimed in claim 26, and providing ridges as the protrusions.

36. The method as claimed in claim 35 and arranging the ridges longitudinally relative to a general path of travel of the web.

37. A method for imparting soft hand to a web of a fabric material having a first side and an opposite second side, the method comprising steps of:

providing a first physical contact member and a second physical contact member;

advancing the web with the first side in continuous rubbing engagement with the first physical contact member and with the second side in continuous rubbing engagement with the second physical contact member, whereby localized tension is developed in the web;

and introducing moisture to the web.

38. A method for imparting soft hand to a web of a fabric material having a first side and an opposite second side, the method comprising steps of:

providing a first physical contact member and a second physical contact member;

advancing the web with the first side in continuous rubbing engagement with the first physical contact member and with the second side in continuous rubbing engagement with the second physical contact member, whereby localized tension is developed in the web;

and introducing heat to the web.

39. A method for imparting soft hand to a web of a fabric material having a first side and an opposite second side, the method comprising steps of:

providing a first physical contact member and a second physical contact member;

advancing the web with the first side in continuous rubbing engagement with the first physical contact member and with the second side in continuous rubbing engagement with the second physical contact member, whereby localized tension is developed in the web;

and cooling the web.

* * * * *